US008341883B2

(12) United States Patent
Weder

(10) Patent No.: US 8,341,883 B2
(45) **Date of Patent: *Jan. 1, 2013**

(54) SLEEVE WITH ANGULAR ARCUATE LOWER END

(75) Inventor: Donald E. Weder, Highland, IL (US)

(73) Assignee: Wanda M. Weder & William F. Straeter, Highland, IL (US), not individually but solely as Trustees of The Family Trust U/T/S dated December 8, 1995

( * ) Notice: Subject to any disclaimer, the term of this patent is extended or adjusted under 35 U.S.C. 154(b) by 0 days.

This patent is subject to a terminal disclaimer.

(21) Appl. No.: 13/494,378

(22) Filed: Jun. 12, 2012

(65) Prior Publication Data

US 2012/0255227 A1 Oct. 11, 2012

Related U.S. Application Data

(63) Continuation of application No. 13/087,159, filed on Apr. 14, 2011, now Pat. No. 8,205,383, which is a continuation of application No. 12/876,677, filed on Sep. 7, 2010, now abandoned, which is a continuation of application No. 12/156,497, filed on Jun. 2, 2008, now abandoned, which is a continuation of application No. 11/210,572, filed on Aug. 24, 2005, now abandoned, which is a continuation of application No. 10/691,064, filed on Oct. 22, 2003, now abandoned, which is a continuation of application No. 09/689,504, filed on Oct. 13, 2000, now abandoned, said application No. 11/210,572 is a continuation-in-part of application No. 10/418,886, filed on Apr. 18, 2003, now abandoned, which is a continuation of application No. 10/165,971, filed on Jun. 7, 2002, now Pat. No. 6,571,536, which is a continuation of application No. 09/746,383, filed on Dec. 21, 2000, now Pat. No. 6,418,698, which is a continuation of application No. 09/189,033, filed on Nov. 10, 1998, now Pat. No. 6,185,904, which is a continuation-in-part of application No. 09/080,771, filed on May 18, 1998, now Pat. No. 6,182,395, which is a continuation of application No. 08/606,957, filed on Feb. 26, 1996, now abandoned.

(51) Int. Cl.
*A01G 9/02* (2006.01)

(52) U.S. Cl. ..... 47/72

(58) Field of Classification Search ..... 47/72
See application file for complete search history.

(56) References Cited

U.S. PATENT DOCUMENTS 524,219 A 8/1894 Schmidt (Continued)

FOREIGN PATENT DOCUMENTS

AU 4231978 6/1979

(Continued)

OTHER PUBLICATIONS

Speed Cover Brochure, "The Simple Solution for Those Peak Volume Periods", Highland Supply Corporation, © 1989.

(Continued)

*Primary Examiner* — Frank T Palo
(74) *Attorney, Agent, or Firm* — Dunlap Codding, PC

(57) ABSTRACT

A plant packaging and covering system comprising a floral sleeve having a lower portion and optionally an upper detachable portion which may be sized to surround a plant disposed in a pot. The floral sleeve has a lower end having an angular arcuate portion for improving the conformation of the sleeve to the shape of a pot.

20 Claims, 3 Drawing Sheets

U.S. PATENT DOCUMENTS

| | | | |
|---|---|---|---|
| 732,889 | A | 7/1903 | Paver |
| 950,785 | A | 3/1910 | Pene |
| 1,044,260 | A | 11/1912 | Schloss |
| 1,063,154 | A | 5/1913 | Bergen |
| 1,446,563 | A | 2/1923 | Hughes |
| 1,520,647 | A | 12/1924 | Hennigan |
| 1,525,015 | A | 2/1925 | Weeks |
| 1,610,652 | A | 12/1926 | Bouchard |
| 1,697,751 | A | 1/1929 | Blake |
| 1,794,212 | A | 1/1929 | Snyder |
| 1,811,574 | A | 3/1930 | Barrett |
| 1,863,216 | A | 6/1932 | Wordingham |
| 1,978,631 | A | 10/1934 | Herrlinger |
| 2,048,123 | A | 7/1936 | Howard |
| RE21,065 | E | 5/1939 | Copeman |
| 2,170,147 | A | 8/1939 | Lane |
| 2,200,111 | A | 5/1940 | Bensel |
| 2,278,673 | A | 4/1942 | Savada et al. |
| 2,302,259 | A | 11/1942 | Rothfuss |
| 2,323,287 | A | 7/1943 | Amberg |
| 2,355,559 | A | 8/1944 | Renner |
| 2,371,985 | A | 3/1945 | Freiberg |
| 2,411,328 | A | 11/1946 | MacNab |
| 2,510,120 | A | 6/1950 | Leander |
| 2,529,060 | A | 11/1950 | Trillich |
| 2,621,142 | A | 12/1952 | Wetherell |
| 2,648,487 | A | 8/1953 | Linda |
| 2,688,354 | A | 9/1954 | Berger |
| 2,688,914 | A | 9/1954 | Eckler |
| 2,774,187 | A | 12/1956 | Smithers |
| 2,822,287 | A | 2/1958 | Avery |
| 2,846,060 | A | 8/1958 | Yount |
| 2,850,842 | A | 9/1958 | Eubank, Jr. |
| 2,883,262 | A | 4/1959 | Borin |
| 2,989,828 | A | 6/1961 | Warp |
| 3,003,681 | A | 10/1961 | Orsini |
| 3,022,605 | A | 2/1962 | Reynolds |
| 3,080,680 | A | 3/1963 | Reynolds et al. |
| 3,094,810 | A | 6/1963 | Kalpin |
| 3,121,647 | A | 2/1964 | Harris et al. |
| 3,130,113 | A | 4/1964 | Silman |
| 3,172,796 | A | 3/1965 | Gülker |
| 3,271,922 | A | 9/1966 | Wallerstein et al. |
| 3,293,100 | A | 12/1966 | Questel |
| 3,316,675 | A | 5/1967 | Cartwright, Jr. |
| 3,322,325 | A | 5/1967 | Bush |
| 3,357,152 | A | 12/1967 | Geigel |
| 3,375,607 | A | 4/1968 | Melvoid |
| 3,376,666 | A | 4/1968 | Leonard |
| 3,380,646 | A | 4/1968 | Doyen et al. |
| 3,405,863 | A | 10/1968 | Kugler |
| 3,431,706 | A | 3/1969 | Stuck |
| 3,508,372 | A | 4/1970 | Wallerstein et al. |
| 3,510,054 | A | 5/1970 | Sanni et al. |
| 3,512,700 | A | 5/1970 | Evans et al. |
| 3,550,318 | A | 12/1970 | Remke et al. |
| 3,552,059 | A | 1/1971 | Moore |
| 3,554,434 | A | 1/1971 | Anderson |
| 3,556,389 | A | 1/1971 | Gregoire |
| 3,557,516 | A | 1/1971 | Brandt |
| 3,613,309 | A | 10/1971 | Coburn |
| 3,620,366 | A | 11/1971 | Parkinson |
| 3,681,105 | A | 8/1972 | Milutin et al. |
| 3,739,522 | A | 6/1973 | Greenbaum |
| 3,767,104 | A | 10/1973 | Bachman et al. |
| 3,793,799 | A | 2/1974 | Howe et al. |
| 3,804,322 | A | 4/1974 | Ericson |
| 3,869,828 | A | 3/1975 | Matsumoto |
| 3,872,621 | A | 3/1975 | Greenbaum |
| 3,888,443 | A | 6/1975 | Flanigen |
| 3,962,503 | A | 6/1976 | Crawford |
| 4,043,077 | A | 8/1977 | Stonehocker |
| 4,054,697 | A | 10/1977 | Reed et al. |
| 4,091,925 | A | 5/1978 | Griffo et al. |
| 4,113,100 | A | 9/1978 | Soja et al. |
| 4,118,890 | A | 10/1978 | Shore |
| 4,149,339 | A | 4/1979 | Hall et al. |
| 4,170,618 | A | 10/1979 | Adams |
| 4,189,868 | A | 2/1980 | Tymchuck et al. |
| 4,216,620 | A | 8/1980 | Weder et al. |
| 4,248,347 | A | 2/1981 | Trimbee |
| 4,258,501 | A | 3/1981 | Brown |
| D259,333 | S | 5/1981 | Charbonneau |
| 4,265,049 | A | 5/1981 | Gorewitz |
| 4,280,314 | A | 7/1981 | Stuck |
| 4,297,811 | A | 11/1981 | Weder |
| 4,299,056 | A | 11/1981 | Towning |
| 4,333,267 | A | 6/1982 | Witte |
| 4,347,686 | A | 9/1982 | Wood |
| 4,380,564 | A | 4/1983 | Cancio et al. |
| 4,400,910 | A | 8/1983 | Koudstall et al. |
| 4,413,725 | A | 11/1983 | Bruno et al. |
| 4,508,223 | A | 4/1985 | Catrambone |
| D279,279 | S | 6/1985 | Wagner |
| 4,546,875 | A | 10/1985 | Zweber |
| 4,570,423 | A | 2/1986 | DeLong |
| 4,621,733 | A | 11/1986 | Harris |
| 4,640,079 | A | 2/1987 | Stuck |
| 4,674,972 | A | 6/1987 | Wagner |
| 4,692,111 | A | 9/1987 | Wagner |
| 4,717,262 | A | 1/1988 | Roen et al. |
| 4,733,521 | A | 3/1988 | Weder et al. |
| 4,765,464 | A | 8/1988 | Ristvedt |
| 4,769,126 | A | 9/1988 | Roen et al. |
| 4,771,573 | A | 9/1988 | Stengel |
| 4,773,182 | A | 9/1988 | Weder et al. |
| 4,779,998 | A | 10/1988 | Wischusen, III |
| 4,801,014 | A | 1/1989 | Meadows |
| 4,810,109 | A | 3/1989 | Castel |
| 4,835,834 | A | 6/1989 | Weder |
| D301,991 | S | 7/1989 | Van Sant |
| D304,317 | S | 10/1989 | Wagner |
| 4,900,390 | A | 2/1990 | Colten et al. |
| 4,918,861 | A | 4/1990 | Carpenter |
| 4,941,572 | A | 7/1990 | Harris |
| 4,946,290 | A | 8/1990 | Matyja |
| 4,980,209 | A | 12/1990 | Hill |
| 4,989,396 | A | 2/1991 | Weder et al. |
| D315,700 | S | 3/1991 | Stephens |
| 5,020,750 | A | 6/1991 | Vrooman et al. |
| 5,073,161 | A | 12/1991 | Weder et al. |
| 5,074,675 | A | 12/1991 | Osgood |
| 5,076,011 | A | 12/1991 | Stehouwer |
| 5,105,599 | A | 4/1992 | Weder |
| 5,111,638 | A | 5/1992 | Weder |
| 5,117,584 | A | 6/1992 | Ottenwalder |
| 5,120,382 | A | 6/1992 | Weder |
| 5,152,100 | A | 10/1992 | Weder et al. |
| 5,181,364 | A | 1/1993 | Weder |
| D335,105 | S | 4/1993 | Ottenwalder et al. |
| 5,199,242 | A | 4/1993 | Weder et al. |
| 5,205,108 | A | 4/1993 | Weder et al. |
| 5,228,234 | A | 7/1993 | de Klerk et al. |
| 5,235,782 | A | 8/1993 | Landau |
| 5,239,775 | A | 8/1993 | Landau |
| 5,241,783 | A | 9/1993 | Krueger |
| 5,249,407 | A | 10/1993 | Stuck |
| 5,259,106 | A | 11/1993 | Weder et al. |
| 5,307,606 | A | 5/1994 | Weder |
| 5,315,785 | A | 5/1994 | Avôt et al. |
| 5,350,240 | A | 9/1994 | Billman et al. |
| 5,353,575 | A | 10/1994 | Stepanek |
| 5,361,482 | A | 11/1994 | Weder et al. |
| 5,363,592 | A | 11/1994 | Weder et al. |
| 5,388,695 | A | 2/1995 | Gilbert |
| 5,428,939 | A | 7/1995 | Weder et al. |
| 5,443,670 | A | 8/1995 | Landau |
| D362,829 | S | 10/1995 | Wagner |
| 5,493,809 | A | 2/1996 | Weder et al. |
| D368,025 | S | 3/1996 | Sekerak et al. |
| 5,496,251 | A | 3/1996 | Cheng |
| 5,496,252 | A | 3/1996 | Gilbert |
| 5,497,913 | A | 3/1996 | Baker |
| 5,501,358 | A | 3/1996 | Hobday |
| 5,526,932 | A | 6/1996 | Weder |
| 5,551,570 | A | 9/1996 | Shaffer et al. |
| 5,572,849 | A | 11/1996 | Weder et al. |

| | | | | |
|---|---|---|---|---|
| 5,572,851 | A | 11/1996 | Weder | |
| 5,575,107 | A | 11/1996 | Doerr | |
| 5,575,133 | A | 11/1996 | Weder et al. | |
| 5,617,703 | A | 4/1997 | Weder | |
| 5,618,105 | A | 4/1997 | Baker | |
| 5,624,320 | A | 4/1997 | Martinez | |
| 5,625,979 | A | 5/1997 | Weder | |
| 5,647,168 | A | 7/1997 | Gilbert | |
| 5,647,193 | A | 7/1997 | Weder et al. | |
| 5,706,604 | A | 1/1998 | Yogi | |
| 5,706,605 | A | 1/1998 | Alzacar | |
| 5,715,944 | A | 2/1998 | Windisch | |
| 5,735,103 | A | 4/1998 | Weder | |
| 5,758,472 | A | 6/1998 | Weder | |
| 5,813,194 | A | 9/1998 | Weder | |
| D399,787 | S | 10/1998 | Wagner | |
| D399,788 | S | 10/1998 | Wagner | |
| D404,684 | S | 1/1999 | Shea | |
| D409,057 | S | 5/1999 | Wagner | |
| 5,924,241 | A | 7/1999 | Hodge | |
| 5,941,020 | A | 8/1999 | Weder | |
| D413,547 | S | 9/1999 | Wagner | |
| 5,966,866 | A | 10/1999 | Ferguson | |
| 5,974,730 | A | 11/1999 | Chien | |
| D419,436 | S | 1/2000 | Celtorius et al. | |
| D419,439 | S | 1/2000 | Markovsky et al. | |
| 6,009,687 | A | 1/2000 | Weder | |
| 6,047,524 | A | 4/2000 | Weder | |
| D424,972 | S | 5/2000 | Ferguson | |
| 6,071,445 | A | 6/2000 | Wagner | |
| D428,827 | S | 8/2000 | Wagner | |
| 6,098,336 | A | 8/2000 | Ferguson | |
| D431,495 | S | 10/2000 | Wagner | |
| 6,129,208 | A | 10/2000 | Ferguson | |
| 6,129,209 | A | 10/2000 | Tchira | |
| 6,141,906 | A | 11/2000 | Weder | |
| D435,481 | S | 12/2000 | Wagner | |
| 6,182,395 | B1 | 2/2001 | Weder | |
| 6,183,590 | B1 | 2/2001 | Weder | |
| D448,130 | S | 9/2001 | Wagner | |
| 6,286,255 | B1 | 9/2001 | Weder et al. | |
| 6,286,256 | B1 | 9/2001 | Weder | |
| 6,345,467 | B1 | 2/2002 | Weder | |
| 6,385,905 | B1 | 5/2002 | Weder | |
| 6,546,669 | B2 | 4/2003 | Weder et al. | |
| 6,598,341 | B2 | 7/2003 | Weder | |
| 8,205,383 | B2 * | 6/2012 | Weder | 47/72 |
| 2003/0209459 | A1 | 11/2003 | Weder | |
| 2004/0003537 | A1 | 1/2004 | Gilbert | |
| 2004/0079026 | A1 | 4/2004 | Weder | |
| 2005/0279022 | A1 | 12/2005 | Weder | |
| 2008/0229660 | A1 | 9/2008 | Weder | |
| 2011/0192083 | A1 | 8/2011 | Weder | |

FOREIGN PATENT DOCUMENTS

| | | |
|---|---|---|
| BE | 654427 | 1/1965 |
| CH | 560532 | 4/1975 |
| DE | 15550 | 6/1900 |
| DE | 345464 | 12/1921 |
| DE | 513971 | 11/1930 |
| DE | 1166692 | 3/1964 |
| DE | 1962947 | 6/1971 |
| DE | 2060812 | 11/1971 |
| DE | 2331839 | 1/1975 |
| DE | 2748626 | 5/1979 |
| DE | 3445799 | 6/1986 |
| DE | 3829281 | 5/1989 |
| DE | 3911847 | 10/1990 |
| DK | 1204647 | 9/1970 |
| EP | 0050990 | 5/1982 |
| EP | 0791543 | 8/1997 |
| FR | 1376047 | 9/1964 |
| FR | 2036163 | 12/1970 |
| FR | 2137325 | 12/1972 |
| FR | 2272914 | 12/1975 |
| FR | 2489126 | 3/1982 |
| FR | 2567068 | 7/1984 |
| FR | 2610604 | 8/1988 |
| FR | 2603159 | 3/1989 |
| FR | 2619698 | 3/1989 |
| FR | 2651663 | 3/1991 |
| FR | 2764273 | 12/1998 |
| GB | 5605 | 0/1885 |
| GB | 1204647 | 9/1970 |
| GB | 2055031 | 2/1981 |
| GB | 2056410 | 3/1981 |
| GB | 2074542 | 11/1981 |
| GB | 2094123 | 9/1982 |
| GB | 2128083 | 4/1984 |
| GB | 2203127 | 10/1988 |
| GB | 2212139 | 7/1989 |
| GB | 2252708 | 8/1992 |
| IT | 224507 | 4/1996 |
| JP | 542958 | 2/1993 |
| JP | 6127555 | 5/1994 |
| JP | 8-19334 | 1/1996 |
| NL | 8301709 | 12/1984 |
| NL | 1000658 | 1/1996 |
| WO | 9315979 | 8/1993 |
| WO | 9712819 | 4/1997 |

OTHER PUBLICATIONS

"Speed Sheets and Speed Rolls" Brochure, Highland Supply Corporation, © 1990.
"Color Them Happy with Highlander Products" © 1992.
"Costa Keeps the Christmas Spirit", Supermarket Floral, Sep. 15, 1992.
"Super Seller", Supermarket Floral, Sep. 15, 1992.
"Halloween", Link Magazine, Sep. 1992.
"Now More Than Ever", Supermarket Floral, Sep. 15, 1992.
Le Plant Sac Advertisement, published prior to Sep. 26, 1987.
"A World of Cut Flower and Pot Plant Packaging" Brochure, Klerk's Plastic Products Manufacturing, Inc., published prior to Mar. 31, 1994, 6 pages.
Chantler & Chantler brochure showing Zipper Sleeve™ and Florasheet®, published prior to Mar. 31, 1994, 2 pages.
"Stand Alone Plastic Bagmaking" brochure, AMI, Atlanta, GA, Feb. 15, 1996, 2 pages.
"Foil Jackets" brochure, Custom Medallion, Inc., Dec. 1996, 2 pages.
"Derwent Abstract" of FR 2610604A. It is noted that the abstract is an incorrect English translation of the contents of the French patent. The French patent does not enable or disclose adhesively attaching the covering to the container. 1988.
"Silver Linings" Brochure, Affinity Diversified Industries, Inc., 1986. The Silver Linings brochure shows a floral sleeve with a closed bottom. The brochure shows , in one embodiment, a vase with flowers inside a "cut flower" sleeve with the sleeve tied with a ribbon about the neck of the vase.
"Special Occasion Printed Highlophane Bags" Brochure, Highland Supply Corporation, 1990, 2 pages.
"Creative Packaging" Brochure, John Henry Company, Sep. 1992.
"Make Highlander Your Headquarters" Brochure, Highland Supply Corporation, 1991.

* cited by examiner

SLEEVE WITH ANGULAR ARCUATE LOWER END

CROSS REFERENCE TO RELATED APPLICATIONS

The present application is a continuation of U.S. Ser. No. 13/087,159, filed Apr. 14, 2011 now U.S. Pat. No. 8,205,383; which is a continuation of U.S. Ser. No. 12/876,677, filed Sep. 7, 2010, now abandoned; which is a continuation of U.S. U.S. Ser. No. 12/156,497, filed Jun. 2, 2008, now abandoned; which is a continuation of U.S. Ser. No. 11/210,572, filed Aug. 24, 2005, now abandoned; which is a continuation of U.S. Ser. No. 10/691,064, filed Oct. 22, 2003, now abandoned; which is a continuation of U.S. Ser. No. 09/689,504, filed Oct. 13, 2000, now abandoned.

Said application U.S. Ser. No. 11/210,572 is also a continuation-in-part of U.S. Ser. No. 10/418,886, filed Apr. 18, 2003, now abandoned; which is a continuation of U.S. Ser. No. 10/165,971, filed Jun. 7, 2002, now U.S. Pat. No. 6,571,536; which is a continuation of U.S. Ser. No. 09/746,383, filed Dec. 21, 2000, now U.S. Pat. No. 6,418,698; which is a continuation of U.S. Ser. No. 09/189,033, filed Nov. 10, 1998, now U.S. Pat. No. 6,815,904; which is a continuation-in-part of U.S. Ser. No. 09/080,771, filed May 18, 1998, now U.S. Pat. No. 6,182,395; which is a continuation of U.S. Ser. No. 08/606,957, filed Feb. 26, 1996, now abandoned.

The entire contents of each of the patents and patent applications listed above are hereby expressly incorporated by reference herein.

FIELD OF THE INVENTIVE CONCEPT(S)

The presently disclosed and claimed inventive concept(s) generally relates to sleeves, and more particularly, to sleeves used to wrap floral groupings or flower pots containing floral groupings and/or mediums containing floral groupings, and methods of using same. U.S. Pat. Nos. 5,625,979, 5,493,809 and 6,815,904 disclose subject matter which may be relevant to the inventive concept(s) contemplated and claimed herein and are hereby expressly incorporated herein by reference in their entirety.

DESCRIPTION OF THE PRESENTLY DISCLOSED AND CLAIMED INVENTIVE CONCEPT(S)

The presently disclosed and claimed inventive concept(s) contemplates in a preferred version a preformed sleeve having a tubular shape sized to contain and conform to a flower pot having an upper end, a lower end and an outer peripheral surface. The preformed sleeve may further comprise a detachable upper portion which may be sized to surround and encompass a floral grouping.

The tubular sleeve may form part of a plant package when used in conjunction with a flower pot disposed within an interior space of the preformed sleeve, the flower pot having a floral grouping disposed therein, and wherein the flower pot is substantially surrounded and encompassed by the sleeve. The floral grouping is at least partially surrounded and encompassed and may be entirely enclosed by the upper portion when it forms a part of the preformed sleeve.

Also, the sleeve may have a bonding material disposed on an inner portion thereof for bondingly connecting to a pot disposed therein. Alternatively, the bonding material may be disposed on an outer portion of the sleeve for forming a plurality of crimps in a base portion of the preformed sleeve.

The base portion of the preformed sleeve may be constructed from a first material and the upper portion (where present) may be constructed from the first material or a second material different from the first material.

These embodiments and others of the presently disclosed and claimed inventive concept(s) are now described in more detail below. It will be appreciated that the examples provided herein are not intended to limit the scope and extent of the claimed inventive concept(s) but are only intended to exemplify various embodiments of the inventive concept(s) contemplated herein.

Figure 1:
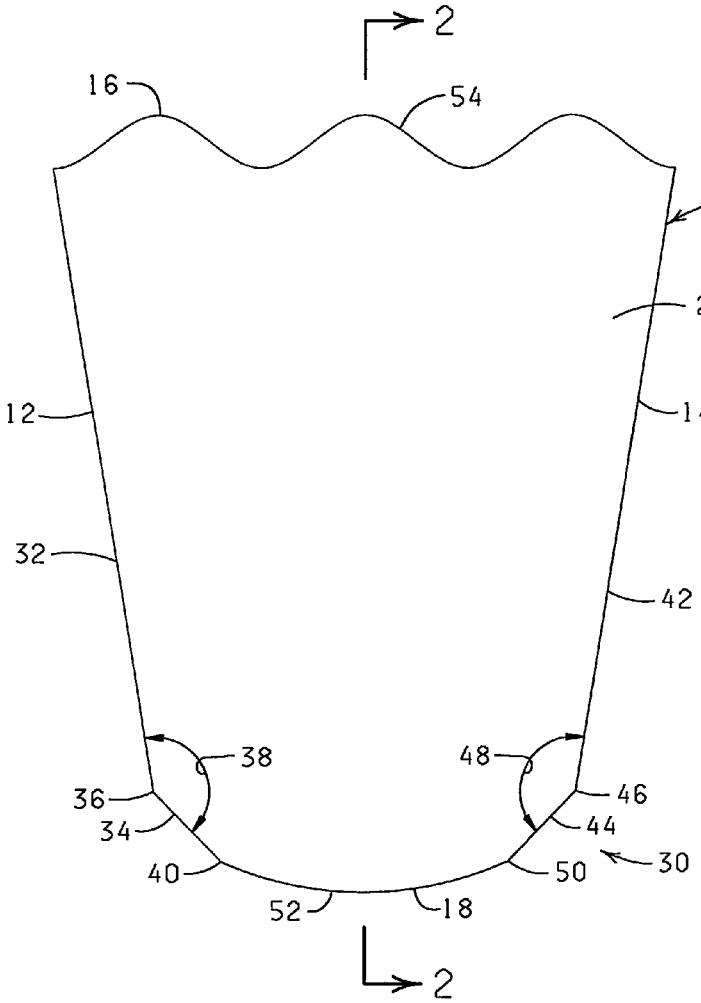
FIG. 1 is an elevational view of a sleeve constructed in accordance with the presently disclosed and claimed inventive concept(s).
Figure 2:
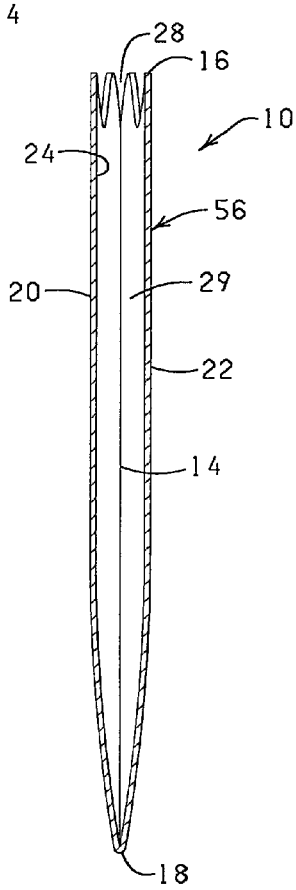
FIG. 2 is a cross-sectional view of the sleeve of FIG. 1 taken along line 2-2.

Turning now to the drawings, shown in FIGS. 1 and 2 is a floral sleeve designated by the general reference numeral 10. Sleeve 10 is provided with a first side 12, a second side 14, an upper end 16, a lower end 18, and a first panel 20 and a second panel 22 which are joined longitudinally along first side 12 and second side 14, and an inner peripheral surface 24. Sleeve 10 is further provided with an upper opening 28 and an interior space 29. The sleeve 10 is individually sized so that a standard sized flower pot, such as a 3-inch, 3½-inch, 4-inch, 4½-inch, 5-inch, 5½-inch, 6-inch, 6½-inch, 7-inch or 8-inch pot, for example, can fit within the sleeve 10, with the pot substantially conforming to the inner peripheral surface 24 of the sleeve 10. The sleeve 10 preferably has a tapered, frustoconical shape, but may also have a rectangular or cylindrical shape, except for the angular arcuate portion described herein. The sleeve 10 is initially formed in a flattened condition and is openable therefrom to an open state for containing a floral container such as a flower pot as described herein.

The sleeve 10 has an angular arcuate portion 30 as described below. The first side 12 of the sleeve 10 comprises a first segment 32 joined to a second segment 34 at a first vertex 36 forming a first angle 38 between the first segment 32 and second segment 34 of first side 12. Second segment 34 has a terminal end 40. The first angle 38 faces inwardly.

The second side 14 has a first segment 42 joined to a second segment 44 at a second vertex 46 forming a second angle 48 between the first segment 42 and second segment 44 of the second side 14. The second segment 44 has a terminal end 50. The second angle 48 faces inwardly and opposes the first angle 38.

The sleeve 10 further comprises a convexly curved arcuate portion 52 extending between the terminal end 40 of the second segment 34 of the first side 12 and the terminal end 50 of the second segment 44 of the second side 14. Preferably the first side 12, the second side 14 and the arcuate portion 52 are sealed along the entire lengths thereof. Together, the first angle 38, the second segment 34 of the first side 12, the second angle 48, the second segment 44 of the end side 14, and the arcuate portion 52 comprise the angular arcuate portion 30 of the sleeve 10.

In a preferred version of the presently disclosed and claimed inventive concept(s), the upper end 16 of the sleeve 10 has an edge 54 which has a non-linear shape, for example having a curve as shown in FIG. 1, thereby forming a skirt portion 56 which preferably extends a distance above an upper rim of a pot when the sleeve 10 is disposed about a pot. Alternatively, the edge 54 may be straight, or arcuate. Other non-linear configurations of edge 54 and of skirt 56 will be readily apparent to one of ordinary skill in the art, for example those shown in FIGS. 2A-2F of U.S. Pat. No. 5,829,225, the entire specification of which is hereby expressly incorporated herein by reference. Each of the first angle 38 and the second angle 48 in the angular arcuate portion 30 is greater than about 90° and less than about 180°.

More preferably, each of the first angle 38 and the second angle 48 is between about 110° and 175°. More preferably, each of the first angle 38 and the second angle 48 is between about 120° and 170°. More preferably, each of the first angle 38 and the second angle 48 is between about 130° and 160°. More preferably, each of the first angle 38 and the second angle 48 is between about 135° and 155°. More preferably, each of the first angle 38 and the second angle 48 is between about 140° and 150°.

Figure 3:
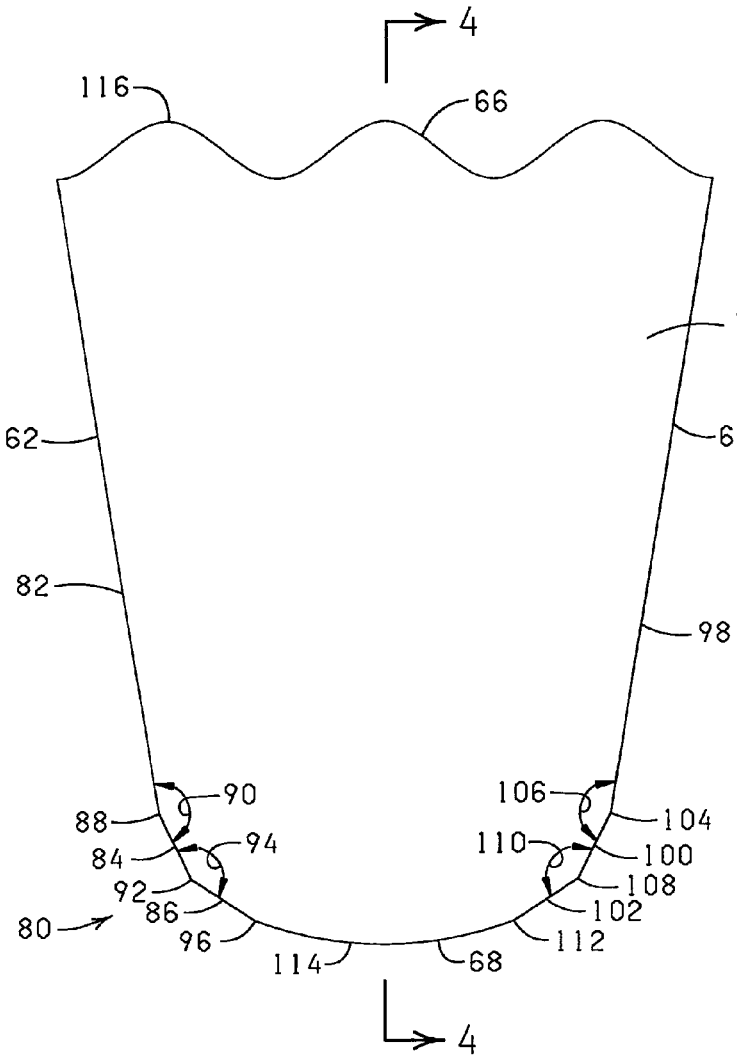
FIG. 3 is an elevational view of a sleeve constructed in accordance with the presently disclosed and claimed inventive concept(s).
Figure 4:
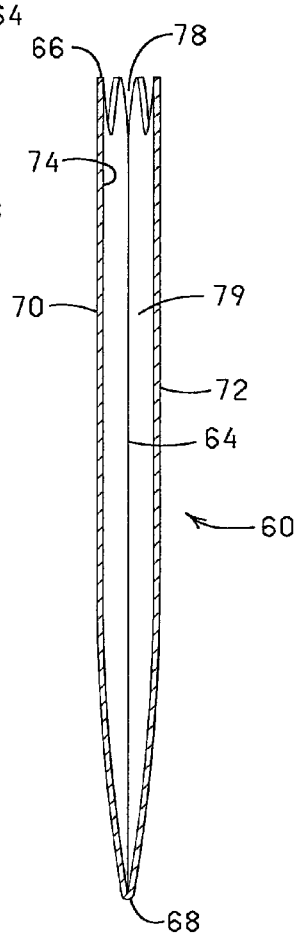
FIG. 4 is a cross-sectional view of the sleeve of FIG. 3 taken along line 4-4.

An alternative embodiment of a sleeve of the presently disclosed and claimed inventive concept(s) is shown in FIGS. 3 and 4 and is designated therein by the general reference numeral 60.

Sleeve 60 is similar to sleeve 10 described above except for the construction of the lower portion. Sleeve 60 is provided with a first side 62, a second side 64, an upper end 66, a lower end 68, and a first panel 70 and a second panel 72 (FIG. 4) which are joined longitudinally along the first side 62 and the second side 64 of the sleeve 60, and an inner peripheral surface 74. Sleeve 60 is further provided with an upper opening 78 and an interior space 79. The sleeve 60 is individually sized so that a standard sized flower pot, such as a 3 inch, 3½ inch, 4 inch, 4½ inch, 5 inch, 5½ inch, 6 inch, 6½ inch, 7 inch or 8 inch pot, for example can fit within the sleeve 60, with the pot substantially conforming to the inner peripheral surface 74 of the sleeve 60. The sleeve 60 preferably has a tapered, frustoconical shape, but may also have a rectangular or cylindrical shape, except for the angular arcuate portion described herein. The sleeve 60 is initially formed in a flattened condition and is openable therefrom to an open state for containing a floral container such as a flower pot as described herein.

The sleeve 60 has an angular arcuate portion 80 as described below. The first side 62 of the sleeve 60 comprises a first segment 82 joined to a second segment 84 at a first vertex 88, and a third segment 86 joined to the second segment 84 at a second vertex 92. The third segment 86 has a terminal end 96. The first vertex 88 forms a first angle 90 between the first segment 82 and the second segment 84 of first side 62. The first angle 90 faces inwardly. The second vertex 92 forms a second angle 94 between the second segment 84 and the third segment 86 of the first side 62. The second angle 94 also faces inwardly.

The second side 64 of the sleeve 60 comprises a first segment 98 joined to a second segment 100 at a third vertex 104, and a third segment 102 joined to the second segment 100 at a fourth vertex 108. The third segment 102 has a terminal end 112. The third vertex 104 forms a third angle 106 between the first segment 98 and the second segment 100 of the second side 64. The third angle 106 faces inwardly. The fourth vertex 108 forms a fourth angle 110 between the second segment 100 and the third segment 102 of the second side 64. The fourth angle 110 faces inwardly. The third angle 106 opposes the first angle 90 and the fourth angle 110 opposes the second angle 94.

The sleeve 60 further comprises a convexly curved arcuate portion 114 extending between the terminal end 96 of the third segment 86 of the first side 62 and the terminal end 112 of the third segment 102 of the second side 64. Preferably the first side 62, the second side 64 of the sleeve 60 and the arcuate portion 114 are sealed along the entire lengths thereof. Together, the first angle 90, the second angle 94, the second segment 84, the third segment 86 of the first side 62, the third angle 106, the fourth angle 110, the second segment 100, the third segment 102 of the second side 64 and the arcuate portion 114 comprise the angular arcuate portion 80 of the sleeve 60.

In a preferred version, the sleeve 60 has an upper end 66 having an edge 116 which has a non-linear shape, for example having a curve as shown in FIG. 3. Alternatively, the edge 116 may be straight or arcuate, or may have a shape as shown in FIGS. 2A-2F of U.S. Pat. No. 5,829,225 described above.

Each of the first angle 90, the second angle 94, the third angle 106 and the fourth angle 110 is greater than about 90° and less than about 180°. More preferably each of the first angle 90, second angle 94, third angle 106 and fourth angle 110 is between about 110° and 175°. More preferably each of the first angle 90, second angle 94, third angle 106 and fourth angle 110 is between about 120° and 170°. More preferably each of the first angle 90, second angle 94, third angle 106 and fourth angle 110 is between about 130° and 160°. More preferably, each of the first angle 90, second angle 94, third angle 106 and fourth angle 110 is between about 135° and 155°. More preferably each of the first angle 90, second angle 94, third angle 106 and fourth angle 110 is between about 140° and 150°.

Figure 5:
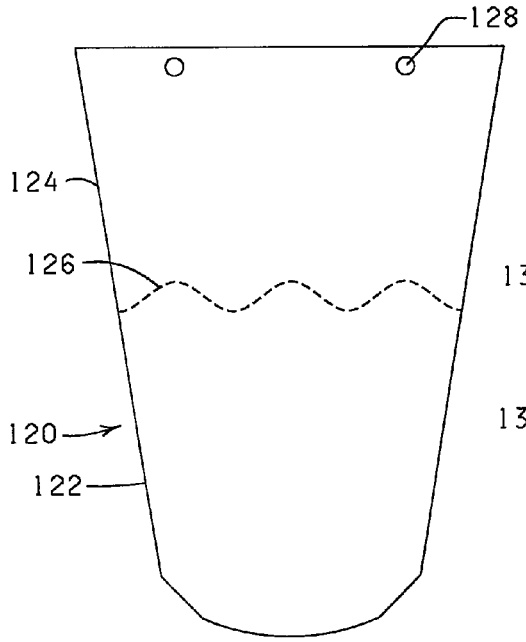
FIG. 5 is an elevational view of another embodiment of a sleeve constructed in accordance with the presently disclosed and claimed inventive concept(s).

Shown in FIG. 5 and designated therein by the general reference numeral 120 is an alternate embodiment of a sleeve of the presently disclosed and claimed inventive concept(s). Sleeve 120 is similar to sleeve 10 shown in FIG. 1 except sleeve 120 comprises both a lower portion 122 and an upper portion 124. The upper portion 124 is detachable from the lower portion 122 via a detaching element 126, such as perforations. The upper portion 124 is generally sized so that it can substantially surround and encompass a floral grouping disposed within a pot disposed within the lower portion 122 of the sleeve 120. The upper portion 124 may have apertures 128 therein for enabling the sleeve 120 to be supported from a support device such as a wicket, in a manner well known to persons of ordinary skill in the art.

Figure 6:
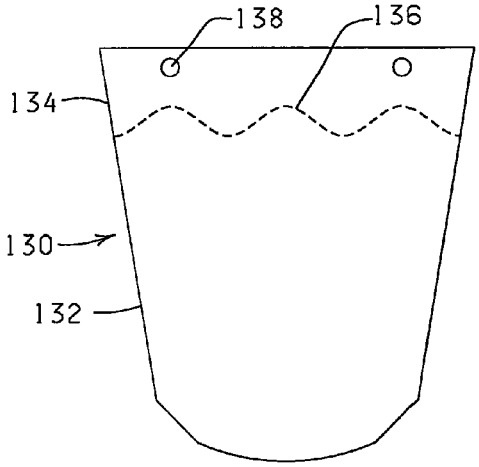
FIG. 6 is an elevational view of another embodiment of a sleeve constructed in accordance with the presently disclosed and claimed inventive concept(s).

Shown in FIG. 6 and designated therein by the general reference numeral 130 is a sleeve similar to sleeve 120. Sleeve 130 comprises a lower portion 132, and an upper portion 134. Upper portion 134 is detachable via a detaching element 136 such as perforations. The upper portion 134 is constructed with apertures 138 therein for enabling the sleeve 130 to be supported by a support device such as a wicket, in a manner well known to a person of ordinary skill in the art. The upper portion 134 of the sleeve 130 is designed to be removed from the lower portion 132 of the sleeve 130 before the lower portion 132 is used to cover a pot.

Figure 7:
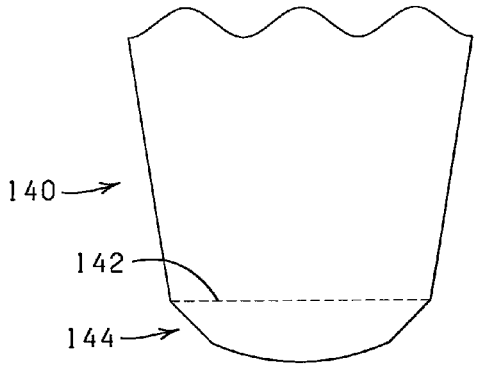
FIG. 7 is an elevational view of another embodiment of a sleeve constructed in accordance with the presently disclosed and claimed inventive concept(s).

Shown in FIG. 7 and designated therein by the general reference numeral 140 is an alternate embodiment of a sleeve of the presently disclosed and claimed inventive concept(s). Sleeve 140 is similar to sleeve 10 shown in FIG. 1 except sleeve 140 has a gusset 142 in an angular arcuate portion 144 thereof. The gusset 142 further enables the angular arcuate portion 144 to be opened and to conform to a bottom portion of a pot disposed therein. Gussets and their construction are well known to persons of ordinary skill in the art, therefore further discussion of their methods of construction is not deemed necessary herein.

Figure 8:
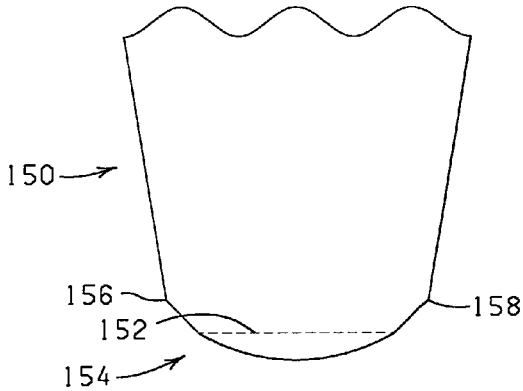
FIG. 8 is an elevational view of another embodiment of a sleeve constructed in accordance with the presently disclosed and claimed inventive concept(s).

Shown in FIG. 8 and designated therein by the general reference numeral 150 is an alternate embodiment of a sleeve of the presently disclosed and claimed inventive concept(s). Sleeve 150 is similar to sleeve 140, and has a gusset 152 in an angular arcuate portion 154 thereof, except the gusset 152 is positioned lower in the angular arcuate portion 154 (below a first angle 156 and a second angle 158) of the sleeve 150.

Any of the sleeves contemplated herein may also be equipped with drainage elements (e.g., one or more holes) in the base portion or bottom thereof or ventilation holes (not shown), or can be made from permeable or impermeable materials.

Any thickness of material may be utilized in accordance with the presently disclosed and claimed inventive concept(s) as long as the sleeves may be formed as described herein, and as long as the formed sleeves may contain at least a portion of a pot or potted plant or floral grouping, as described herein. Additionally, an insulating material such as bubble film, preferable as one of two or more layers, can be utilized in order to provide additional protection for the item, such as the floral grouping, contained therein.

The material from which the sleeves described herein are constructed preferably has a thickness in a range from about 0.1 mil to about 30 mil. Often, the thicknesses of the sleeves are in a range from about 0.5 mil to about 10 mil or preferably, in a range from about 1.0 mil to about 5 mil. More preferably, the sleeves are constructed from a material which is flexible, semi-rigid, rigid, or any combination thereof. The sleeves may be constructed of a single layer of material or a plurality of layers of the same or different types of materials. The layers of material comprising the sleeves may be connected together or laminated or may be separate layers. Such materials used to construct the sleeves are described in U.S. Pat. No. 5,111,637, which is hereby expressly incorporated herein by reference.

The sleeves are constructed from any suitable material that is capable of being formed into a sleeve and wrapped about a pot and a floral grouping disposed therein. Preferably, the material comprises treated or untreated paper, metal foil, polymer film, non-polymer film, woven or nonwoven fabric, or synthetic or natural fabric, cardboard, fiber, cloth, burlap, or laminations or combinations thereof.

In one embodiment, the sleeves contemplated herein may be constructed from sheets comprising two polypropylene films. The material comprising the sleeves may be connected together or laminated or may be separate layers. In an alternative embodiment, the sleeves may be constructed from only one sheet of the polypropylene film.

The term "polymer film" means a synthetic polymer such as a polypropylene or a naturally occurring polymer such as cellophane. A polymer film is relatively strong and not as subject to tearing (substantially non-tearable), as might be the case with paper or foil.

The materials comprising the sleeves may vary in color and as described herein may consist of designs or decorative patterns which are printed, etched, and/or embossed thereon using inks or other printing materials. An example of an ink which may be applied to the surface of the material is described in U.S. Pat. No. 5,147,706, which is hereby expressly incorporated herein by reference.

In addition, the material may have various colorings, coatings, flocking and/or metallic finishes, or other decorative surface ornamentation applied separately or simultaneously or may be characterized totally or partially by pearlescent, translucent, transparent, iridescent, neon, or the like, qualities. The material may further comprise, or have applied thereto, one or more scents. Each of the above-named characteristics may occur alone or in combination and may be applied to the upper and/or lower surface of the material comprising the sleeves. Moreover, portions of the material used in constructing the sleeves may vary in the combination of such characteristics. The material utilized for the sleeves may be opaque, translucent, transparent, or partially clear or tinted transparent.

The term "floral grouping" as used herein means cut fresh flowers, artificial flowers, a single flower or other fresh and/or artificial plants or other floral materials and may include other secondary plants and/or ornamentation or artificial or natural materials which add to the aesthetics of the overall floral grouping. The floral grouping comprises a bloom or foliage portion and a stem portion. Further, the floral grouping may comprise a growing potted plant having a root portion (not shown) as well. However, it will be appreciated that the floral grouping may consist of only a single bloom or only foliage, or a botanical item (not shown), or a propagule (not shown). The term "floral grouping" may be used interchangeably herein with both the terms "floral arrangement" and "potted plant". The term "floral grouping" may also be used interchangeably herein with the terms "botanical item" and/or "propagule".

The term "growing medium", when used herein, means any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as a bouquet or a floral grouping.

The term "propagule" when used herein means any structure capable of being propagated or acting as an agent of reproduction including seeds, shoots, stems, runners, tubers, plants, leaves, roots, or spores.

In accordance with the presently disclosed and claimed inventive concept(s) a bonding material may optionally be disposed on a portion of any of the sleeves described herein to attach each sleeve to a pot having a floral grouping therein when such a pot is disposed within the sleeve or to assist in closing or sealing the upper portion of the sleeve or in adhering the sleeve to the pot after the pot has been disposed therein. Examples of how a bonding material may be disposed on the sleeve are shown in U.S. Pat. Nos. 5,493,809 and 5,625,979, both of which are hereby expressly incorporated herein by reference in their entirety.

The term "detaching element" when used generally herein, means any element or device such as, but not limited to, perforations, tear strips, zippers, and any other devices or elements of this nature known in the art, or any combination thereof, which enable the tearing away or detachment of one object from another. Therefore, while perforations are shown and described in detail herein, it will be understood that tear strips, zippers, or any other "detaching element" known in the art, or any combination thereof, could be substituted therefore and/or used therewith.

The upper portion 124 or 134 of the sleeve 120 or 130, respectively, may also have an additional substantial vertically disposed detaching element comprising a plurality of vertical perforations (not shown) for facilitating removal of the upper portion 124 or 134 thereof from the lower portion 122 or 132, respectively.

As indicated above, it will be understood by a person of ordinary skill in the art that equipment and devices for forming floral sleeves are commercially available, and are well known to a person of ordinary skill in the art. Further detailed discussion of the construction of the sleeves described herein therefore is not deemed necessary. However, briefly, the sleeves described herein may be formed by intermittently advancing two separate webs, one or two webs preformed in the form of a tube, or a single web folded double and sealing the longitudinal sides and bottom of the two facing panels then cutting the sleeve thus formed from the webs or web. Machines which can form sleeves from such single webs or pairs of webs are well within the knowledge of one of ordinary skill in the art.

As noted above, any of the sleeves contemplated herein may have an open or closed lower end. When the lower end is closed, the lower end may have one or more gussets as described elsewhere herein formed therein for allowing expansion of the lower end when an object with a broad lower end such as a pot is disposed therein. In another version, the sleeve may comprise a flap which can be folded over and sealed with a bonding material to close the sleeve.

The term "flower pot" as used herein refers to any type of container used for holding a floral grouping or plant, including vases. Examples of pots, used in accordance with the presently disclosed and claimed inventive concept(s) include, but not by way of limitation, clay pots, wooden pots, plastic pots, pots made from natural and/or synthetic fibers, and/or any combination thereof. The pot is adapted to receive a floral grouping in the retaining space thereof. The floral grouping may be disposed within the pot along with a suitable growing medium described elsewhere herein, or other retaining medium, such as a floral foam. It will also be understood that the floral grouping, and any appropriate growing medium or other retaining medium, may be disposed in the sleeve without a flower pot for cultivating the floral grouping or displaying a grown floral grouping.

It should also be noted that for all versions of sleeves described above which have a bonding material thereon, it may be desirable to have a release material or cover strip covering the adhesive or cohesive bonding material disposed on any portion of the sleeve for preventing the bonding material from bonding to another surface until the desired time. Further, in each of the cases described herein wherein a sleeve is applied to a pot or a covered pot, the sleeve may be applied thereto either by depositing the pot or covered pot downwardly into the open retaining space of the sleeve, or the sleeve may be brought upwardly about the pot or covered pot from below the pot or a covered pot.

It should be further noted that various features of the versions of the presently disclosed and claimed inventive concept(s) such as closure bonding areas, support apertures, handles or handle apertures, additional perforations, drainage elements, ventilation holes, combinations of material may be used alone or in combination as elements of any of the embodiments described above herein Changes may be made in the construction and the operation of the various components, elements and assemblies described herein or in the steps or the sequence of steps of the methods described herein without departing from the spirit and scope of the inventive concept(s) as defined in the following claims.

What is claimed is:

1. A potted plant package, comprising:

a sleeve initially constructed in a flattened condition to an opened condition, the sleeve having an upper end, a lower end, a first side, a second side, and a first panel and a second panel which are connected along the first side and the second side, the sleeve having a single arcuate portion in the lower end thereof in the flattened condition, wherein the first side comprises a first segment and a second segment and having a first angle between the first segment and the second segment and a second angle between the second segment and the arcuate portion, the first and second angles facing inwardly and each being between about 110° and about 175°, wherein the second side comprises a third segment and a fourth segment and having a third angle between the third and fourth segments and a fourth angle between the fourth segment and the arcuate portion, the third and fourth angles facing inwardly and each being between about 110° and about 175°, the first angle, second angle, third angle, fourth angle and the single arcuate portion cooperating to define an angular arcuate portion of the sleeve when the sleeve is in the flattened condition prior to being opened and absent a gusset in the lower end when in the flattened condition, and wherein the sleeve has a generally tapered shape when in the opened condition; and a potted plant disposed in the sleeve.

2. The potted plant package of claim 1, wherein the first angle and the third angle of the sleeve are between about 125° and about 150°, and wherein the second angle and the fourth angle of the sleeve are between about 125° and about 150°.

3. The potted plant package of claim 1, wherein the sleeve further comprises a detachable upper portion.

4. The potted plant package of claim 3, wherein the detachable upper portion is detachable via perforations in the sleeve.

5. The potted plant package of claim 3, wherein the detachable upper portion is sized to substantially surround and enclose a floral grouping of the potted plant.

6. The potted plant package of claim 3, wherein the detachable upper portion is adapted to support the sleeve from a support assembly.

7. The potted plant package of claim 1, wherein the sleeve further comprises a skirt portion.

8. The potted plant package of claim 1, wherein the upper end of the sleeve has a non-linear edge.

9. A method of packaging a potted plant, comprising the steps of:

opening a sleeve initially constructed in a flattened condition to an opened condition, the sleeve having an upper end, a lower end, a first side, a second side, a first panel and a second panel which are connected along the first side and the second side, and a detachable upper portion, the sleeve having a single arcuate portion in the lower end thereof in the flattened condition, wherein the first side comprises a first segment and a second segment and having a first angle between the first segment and the second segment and a second angle between the second segment and the arcuate portion, the first and second angles facing inwardly and each being between about 110° and about 175°, wherein the second side comprises a third segment and a fourth segment and having a third angle between the third and fourth segments and a fourth angle between the fourth segment and the arcuate portion, the third and fourth angles facing inwardly and each being between about 110° and about 175°, the first angle, second angle, third angle, fourth angle and the single arcuate portion cooperating to define an angular arcuate portion of the sleeve when the sleeve is in the flattened condition prior to being opened and absent a gusset in the lower end when in the flattened condition, and wherein the sleeve has a generally tapered shape when in the opened condition; and disposing a potted plant in the sleeve.

10. The method of claim 9, wherein the first angle and the third angle of the sleeve are between about 125° and about 150°, and wherein the second angle and the fourth angle of the sleeve are between about 125° and about 150°.

11. The method of claim 9, wherein the detachable upper portion of the sleeve is detachable via perforations in the sleeve.

12. The method of claim 9, wherein the detachable upper portion of the sleeve is sized to substantially surround and enclose a floral grouping of the potted plant.

13. The method of claim 9, wherein the detachable upper portion of the sleeve is adapted to support the sleeve from a support assembly.

14. The method of claim 9, wherein the sleeve further comprises a skirt portion.

15. The method of claim 9, wherein the upper end of the sleeve has a non-linear edge.

16. A potted plant package, comprising:

a sleeve initially constructed in a flattened condition to an opened condition, the sleeve having an upper end, a lower end, a first side, a second side, a first panel and a second panel which are connected along the first side and the second side, and a detachable upper portion, the sleeve having a single arcuate portion in the lower end thereof in the flattened condition, wherein the first side comprises a first segment and a second segment and having a first angle between the first segment and the second segment and a second angle between the second segment and the arcuate portion, the first and second angles facing inwardly and each being between about 110° and about 175°, wherein the second side comprises a third segment and a fourth segment and having a third angle between the third and fourth segments and a fourth angle between the fourth segment and the arcuate portion, the third and fourth angles facing inwardly and each being between about 110° and about 175°, the first angle, second angle, third angle, fourth angle and the single arcuate portion cooperating to define an angular arcuate portion of the sleeve when the sleeve is in the flattened condition prior to being opened and absent a gusset in the lower end when in the flattened condition, and wherein the sleeve has a generally tapered shape when in the opened condition; and a potted plant disposed in the sleeve.

17. The potted plant package of claim 16, wherein the first angle and the third angle of the sleeve are between about 125° and about 150°, and wherein the second angle and the fourth angle of the sleeve are between about 125° and about 150°.

18. The potted plant package of claim 16, wherein the detachable upper portion is sized to substantially surround and enclose a floral grouping of the potted plant.

19. The potted plant package of claim 16, wherein the detachable upper portion is adapted to support the sleeve from a support assembly.

20. The potted plant package of claim 16, wherein the sleeve further comprises a skirt portion, and wherein the upper end of the sleeve has a non-linear edge.

* * * * *

UNITED STATES PATENT AND TRADEMARK OFFICE

CERTIFICATE OF CORRECTION

PATENT NO. : 8,341,883 B2
APPLICATION NO. : 13/494378
DATED : January 1, 2013
INVENTOR(S) : Donald E. Weder It is certified that error appears in the above-identified patent and that said Letters Patent is hereby corrected as shown below:

On Page 3 of the Title page, Item (56) "References Cited" and under "Foreign Patent Documents": Delete "GB 2212139 7/1989" and replace with
-- GB 2212136 7/1989 --

Signed and Sealed this
Nineteenth Day of February, 2013

Teresa Stanek Rea
*Acting Director of the United States Patent and Trademark Office*